United States Patent [19]

Meijer et al.

[11] Patent Number: 4,703,796

[45] Date of Patent: Nov. 3, 1987

[54] CORROSION RESISTANT HEAT PIPE

[75] Inventors: Roelf J. Meijer; Benjamin Ziph, both of Ann Arbor, Mich.

[73] Assignee: Stirling Thermal Motors, Inc., Ann Arbor, Mich.

[21] Appl. No.: 19,589

[22] Filed: Feb. 27, 1987

[51] Int. Cl.[4] ..... F28D 15/02; F28F 19/00

[52] U.S. Cl. ..... 165/104.26; 165/104.27; 165/134.1

[58] Field of Search ..... 165/104.26, 104.27, 165/134.1

[56] References Cited

U.S. PATENT DOCUMENTS

| | | | |
|---|---|---|---|
| 3,602,297 | 8/1971 | Kraft et al. | 165/104.26 |
| 4,372,377 | 2/1983 | Morris | 165/134.1 |
| 4,478,275 | 10/1984 | Ernst | 165/104.27 |
| 4,586,561 | 5/1986 | Franco et al. | 165/104.27 |

*Primary Examiner*—Albert W. Davis, Jr.

[57] ABSTRACT

A corrosion resistant heat pipe construction which prevents the formation of corrosive oxides of sodium which may result when a sodium heat transport medium combines with oxygen within the heat pipe. In accordance with this invention, formation of such corrosive compounds is inhibited through the introduction of zirconium in the form of a fine thread woven into the heat pipe wick. When the wick is installed within the heat pipe, the zirconium will react with oxygen to form a relatively non-corrosive zirconium oxide. By introducing the zirconium thread into the wick material matrix, the fabrication of the heat pipe is carried out in accordance with present techniques, without requiring the addition of other components or operations.

2 Claims, 3 Drawing Figures

CORROSION RESISTANT HEAT PIPE

BACKGROUND AND SUMMARY OF THE INVENTION

This invention relates to a heat pipe thermal transport apparatus and particularly to one having means for reducing the formation of corrosive compounds within the heat pipe.

In general, heat pipes are comprised of a tube having separated evaporator and condensor portions. An external heat source supplies heat to the evaporator portion and a heat sink extracts heat from the condensor portion. Heat pipes are typically sealed and filled with a heat transport fluid medium. During operation, the heat transport medium in a liquid phase is vaporized in the evaporator portion by heat supplied from the external source. The vaporized heat transport medium which contains the latent heat of vaporization flows to the condensor portion of the heat pipe. The vaporous heat transport medium condenses in the condensor portion, thereby giving up its latent heat. Substantially all the internal surfaces of the heat pipe are lined with a wick comprised of a fine porous material. The wick operates to transport the liquid heat transport medium to the evaporator portion by capillary action.

Various working fluids are used as a heat pipe transport medium. One frequently used substance is metallic sodium. During fabrication, the internal cavity of the heat pipe is evacuated and is thereafter charged with the working substance. During charging of the heat pipe, it is virtually impossible to completely remove oxygen from the heat pipe interior cavity. Therefore, after fabrication, some oxygen is present within the heat pipe. When sodium combines with oxygen, highly corrosive sodium oxide is formed. This material can react with the heat pipe housing, which is typically made of a metal, causing it to corrode, thus degrading its structural integrity and heat transfer characteristics. It is, accordingly, an object of the present invention to inhibit the formation of oxides of sodium within the heat pipe interior. It is a further object of this invention to provide this improvement without complicating the heat pipe fabrication process.

In accordance with the present invention, corrosive sodium oxide formation is inhibited through the intentional introduction of substantially pure zirconium into the heat pipe interior. The presence of zirconium causes free oxygen within the heat pipe to react with the zirconium to produce a non-corrosive oxides of zirconium. In accordance with this invention, substantially pure sirconium is introduced into the heat pipe by forming it into long threads which are weaved into a mesh type wick material.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE INVENTION

Figure 1:
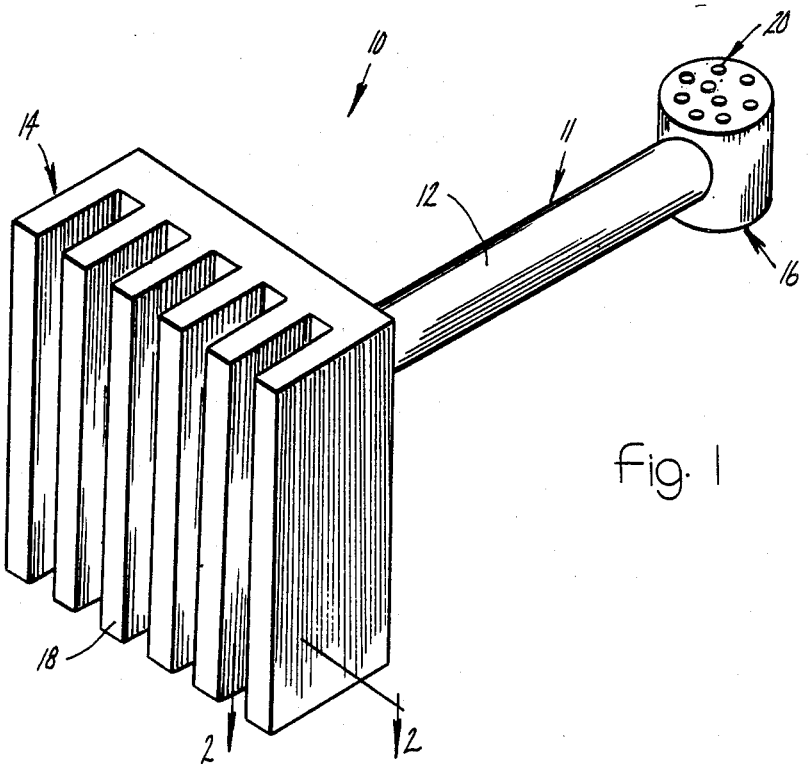
FIG. 1 is a pictorial view of an exemplary heat pipe having the improvements according to this invention.
Figure 2:
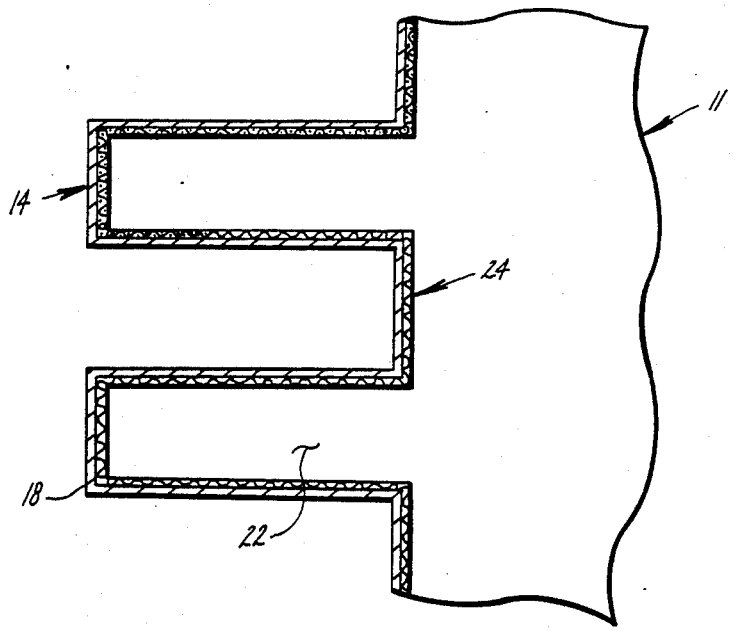
FIG. 2 is an enlarged partial cross-sectional view taken along line 2—2 of FIG. 1.

A corrosion resistant heat pipe in accordance with the present invention is shown in FIGS. 1 and 2 and is generally designated by reference number 10. Heat pipe 10 is described and illustrated herein as an example of one configuration of a heat pipe which can incorporate the improvements according to this invention. This example of a heat pipe is identical to that described in U.S. Pat. No. 4,523,636, assigned to the assignee of this invention, which is hereby incorporated by reference. Heat pipe 10 is comprised of a housing 11 defining tube 12 having evaporator portion 14 and condensor portion 16 disposed at opposite ends. As previously stated, evaporator portion 14 would be exposed to an external heat source during use, whereas condensor portion 16 would be thermally coupled to an external heat sink.

Evaporator portion 14 defines a plurality of substantially parallel hollow fins 18. Hollow fins 18 increase the internal and external surface areas of evaporator portion 14, as explained in the previously mentioned issued U.S. patent. Condensor portion 16 is generally cylindrical in shape and defines cylindrical passages 20 which are intended to enable a fluid medium to be transmitted therethrough.

Heat pipe 10 has a hollow interior cavity 22 which is filled with a working fluid. Wick 18 is a woven fabric which is positioned against the inside surface of the heat pipe. Wick 24 serves to distribute the heat pipe working fluid in the liquid phase by capillary action.

Heat pipe 10, in accordance with the present invention, is filled with substantially pure sodium. Once heat pipe 10 is fabricated, any free oxygen within the heat pipe interior will combine with the sodium working fluid to produce sodium oxide. Sodium oxide is a corrosive compound which has been found to degrade heat pipe housing 11 which is typically made of metal.

Figure 3:
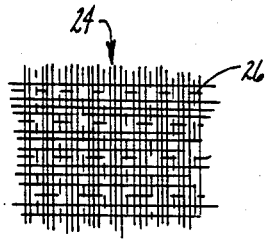
FIG. 3 is a pictorial view of a portion of wick material used within a heat pipe according to this invention.

In accordance with the present invention, the development of sodium oxide is inhibited through the intentional introduction of substantially pure zirconium (Zr). Zirconium combines with free oxygen to form zirconium oxide ($ZrO_2$) and sodium (Na). FIG. 3 illustrates the manner in which zirconium is introduced into interior cavity 22 of heat pipe 10. Wick 24 is a matrix of woven threads. These threads may be comprised of textile materials or metal filaments. In accordance with this invention, threads of zirconium 26 are woven into the matrix of wick 24. For example, every fifth or tenth thread comprising wick 24 may be a zirconium thread 26. FIG. 3 shows a portion of wick 24 wherein threads indicated in broken lines are zirconium threads 26, and the remaining threads are made from some other material. Once the zirconium thread 26 is woven into the matrix of wick 24 in this manner, the wick may be installed within interior cavity 22 in the ordinary fashion. Accordingly, zirconium is incorporated into heat pipe interior 22 without the requirement of adding additional components or complicating the process of fabricating heat pipe 10.

While the above description constitutes the preferred embodiments of the present invention, it will be appreciated that the invention is susceptible to modification, variation and change without departing from the proper scope and fair meaning of the accompanying claims.

What is claimed is:

1. In a heat pipe of the type having a hollow interior cavity with evaporator and condensor portions which is charged with sodium as a working fluid and having a wick lining at least a portion of the internal surface of the heat pipe housing, the improvement comprising:

said wick being formed of a mesh wherein a plurality of zirconium threads are interwoven into said wick mesh so that, when said wick is installed within said heat pipe, oxygen therein will combine with said zirconium to form zirconium oxide, thus inhibiting the formation of corrosive sodium oxides.

2. A mesh adapted to be used as a wick for a heat pipe which is charged with a sodium working fluid comprising:

said mesh having a plurality of threads made of zirconium so that, when said wick is installed within said heat pipe, oxygen therein will combine with said zirconium to form zirconium oxide, thus inhibiting the formation of corrosive sodium oxides.

* * * * *